US007275940B2

(12) United States Patent
Chen

(10) Patent No.: US 7,275,940 B2
(45) Date of Patent: Oct. 2, 2007

(54) USB CONNECTOR WITH CLIPPING GROOVES

(76) Inventor: Chien-Chiu Chen, No. 2 , Alley 9, Lane 45, Pao-Hsin Rd., Hsin-Tien Taipei (TW)

( * ) Notice: Subject to any disclaimer, the term of this patent is extended or adjusted under 35 U.S.C. 154(b) by 0 days.

(21) Appl. No.: 11/470,589

(22) Filed: Sep. 6, 2006

(65) Prior Publication Data

US 2007/0123071 A1 May 31, 2007

(30) Foreign Application Priority Data

Nov. 25, 2005 (TW) ..... 94220526 U

(51) Int. Cl.
*H01R 12/00* (2006.01)

(52) U.S. Cl. ..... 439/79

(58) Field of Classification Search ..... 439/493, 439/607, 76.1, 79
See application file for complete search history.

(56) References Cited

U.S. PATENT DOCUMENTS 5,310,360 A * 5/1994 Peterson ..... 439/571
5,971,775 A * 10/1999 Tor et al. ..... 439/79
5,975,954 A * 11/1999 Wu et al. ..... 439/607
6,341,988 B1 * 1/2002 Zhu et al. ..... 439/630
6,398,587 B1 * 6/2002 Chen et al. ..... 439/607
6,554,648 B2 * 4/2003 Shi et al. ..... 439/607
6,902,432 B2 * 6/2005 Morikawa et al. ..... 439/607
6,945,824 B1 * 9/2005 Li et al. ..... 439/660

* cited by examiner

*Primary Examiner*—Briggitte Hammond
*Assistant Examiner*—Larisa Tsukerman

(57) ABSTRACT

A USB connector comprises an insert-molded member formed by insert molding technology and a metal shell, wherein the insert-molded member includes an insulative housing and a plurality of conductive terminals. The terminal bearing portion of the insert-molded member extends outward a first side arm and a second side arm having a clipping groove on two sides thereof. The rear part of each conductive terminal has an arch portion, which defines an interfering portion connected with a circuit board. A circuit board can be inserted into the clipping grooves of the insert-molded member from the rear side of the connector, then the conductive terminals press against the circuit board tightly for the arch portion on the rear part thereof with its elasticity and achieve signal transmission by connecting the interfering portion thereof with the circuit board.

3 Claims, 3 Drawing Sheets

USB CONNECTOR WITH CLIPPING GROOVES

BACKGROUND OF THE INVENTION

1. Field of the Invention

The present invention relates to a USB connector, and more particularly to a USB connector which can be mounted on a circuit board directly with clipping grooves thereof.

2. Description of Related Art

The Universal Serial Bus (USB) connector is engineered to transmit different kinds of input/output signals. It is also one of the electrical connectors commonly used at present time for data transmission, allowing the user to plug or unplug in power-on state, which is very convenient for user. In computer accessories or peripheral devices (Such as, scanner, digital camera, keyboard and the like peripheral devices.), it mostly applies a USB connector as transmission interface. As shown in FIG.1, which shows a conventional USB connector 100, after the electrical terminals 80 and the insulative housing 70 are individually finished their manufacture process, the electrical terminals 80 need to be assembled within the insulative housing 70, and an external force is required to apply thereto during assembly. Sometimes, for the force applied by hand is not enough, a special tool is further needed to position the electrical terminals 80 within the insulative housing 70, when the connector 100 is matching with the circuit board, the connector 100 must be provided with a locating mechanism 61 to secure the next soldering process to go on properly. No doubt the connector 100 increases an assembling process and a soldering process in assembling operation, and a special tool is further needed during the assembly process, causing the cost expenditure increase. Because of the existing defects, the conventional connector is necessary to be improved.

SUMMARY OF THE INVENTION

The primary object of the present invention is to provide a USB connector, more particularly relates to a USB connector which can clip a circuit board directly by a clipping groove, thereby reducing operation procedures during assembly and improve production efficiency.

To achieve the above objects, the present invention takes advantage of the following technique scheme. The USB connector according to the present invention comprises an insert-molded member formed by insert-molding technology and a metal shell, wherein the insert-molded member is an integral body injection-molded via a mold and composed by an insulative housing and a plurality of conductive terminals. The terminal bearing portion of the insulative housing extends outward two convex tabs on the upper and lower surfaces respectively adjacent to the rear surface thereof, and between the two convex tabs on the upper surface of the terminal bearing portion having a recess, wherein the convex tabs and the recess are mainly adapted to prevent the insert-molded member from shifting back and forth when the insert-molded member and the metal shell are assembled, thus the insert-molded member is securely positioned in place. The terminal bearing portion extends outward a first side arm and a second side arm being even with the two side surfaces thereof, each having a clipping groove for being inserted by a circuit board, the area defined by the first side arm and the second side arm is provided for disposing the rear parts of conductive terminals. The rear part of each conductive terminal has an arch portion on which an interfering portion is defined for contacting with a contact of the circuit board. The metal shell is in shape of a rectangular figure communicated both front and back. When the insert-molded member is securely assembled with the metal shell, a circuit board can be inserted into the clipping grooves on the first and second side arms from rear side of the connector, the conductive terminals are therefore pressed against the circuit board tightly for the arch portion on the rear part thereof with its elasticity, therefore the circuit board can be connected with the connector without needing to solder and achieve signal transmission through the interfering portion and a contact of the circuit board.

The above and other objects, features and advantages of the present invention will become apparent from the following detailed description taken with the accompanying drawings.

DETAILED DESCRIPTION OF THE PREFERRED EMBODIMENT

Figure 1:
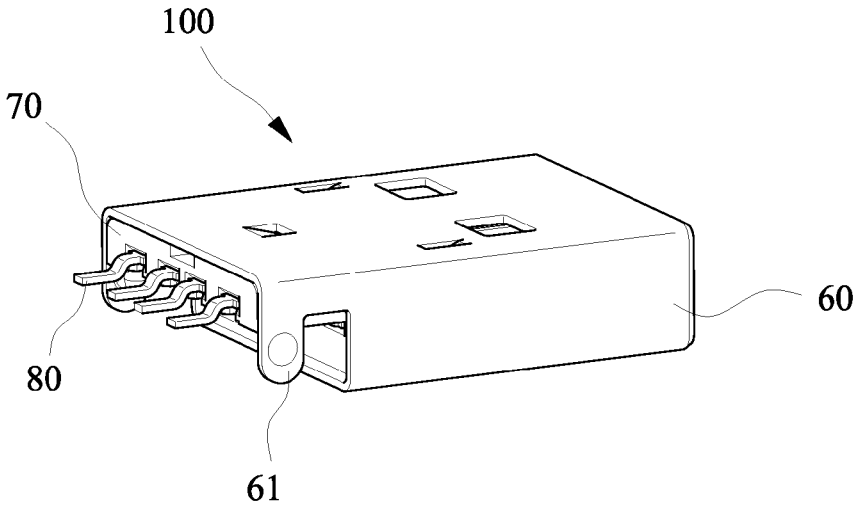
FIG. 1(PRIOR ART)
FIG. 1 is a perspective view showing a conventional USB connector.
Figure 2:
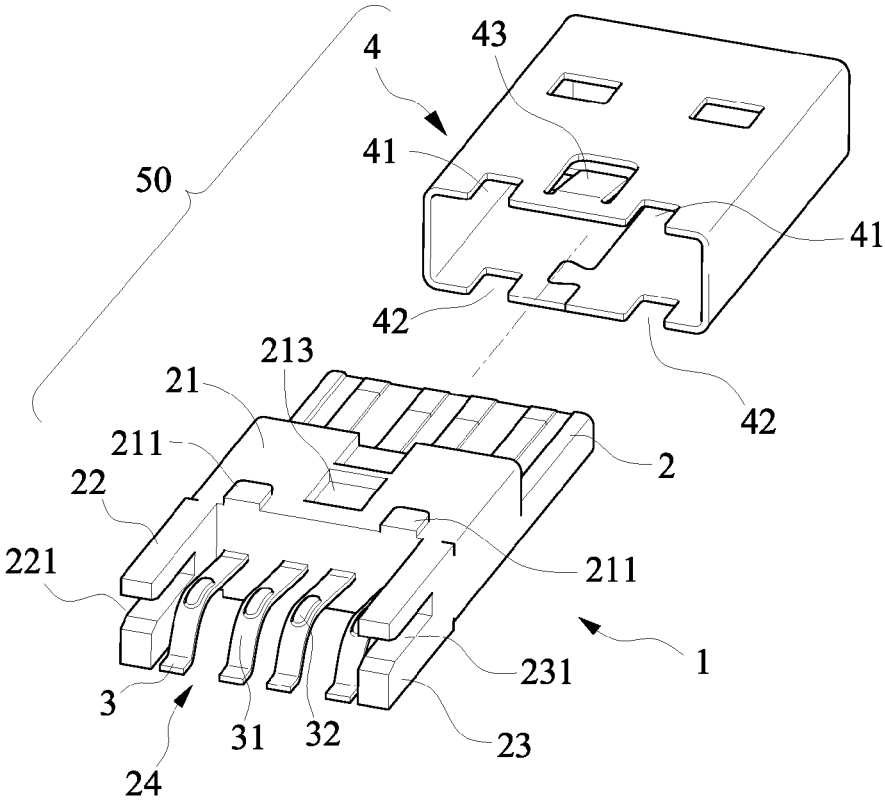
FIG. 2 is an exploded perspective view showing a USB connector according to the present invention.

Referring to FIG. 2, which shows a USB connector 50 of a preferred embodiment according to the present invention. The USB connector 50 comprises an insulative housing 2, a plurality of conductive terminals 3, and a metal shell 4, wherein the insulative housing 2 and the conductive terminals 3 are insert-molded as an integral housing body 1 having a front terminal bearing portion.

Figure 3:
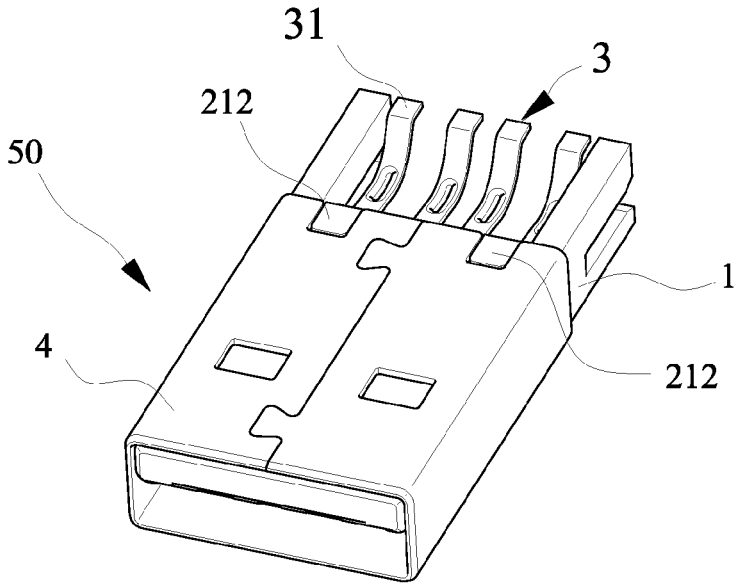
FIG. 3 is a perspective view showing the USB connector shown in FIG. 2.
Figure 4:
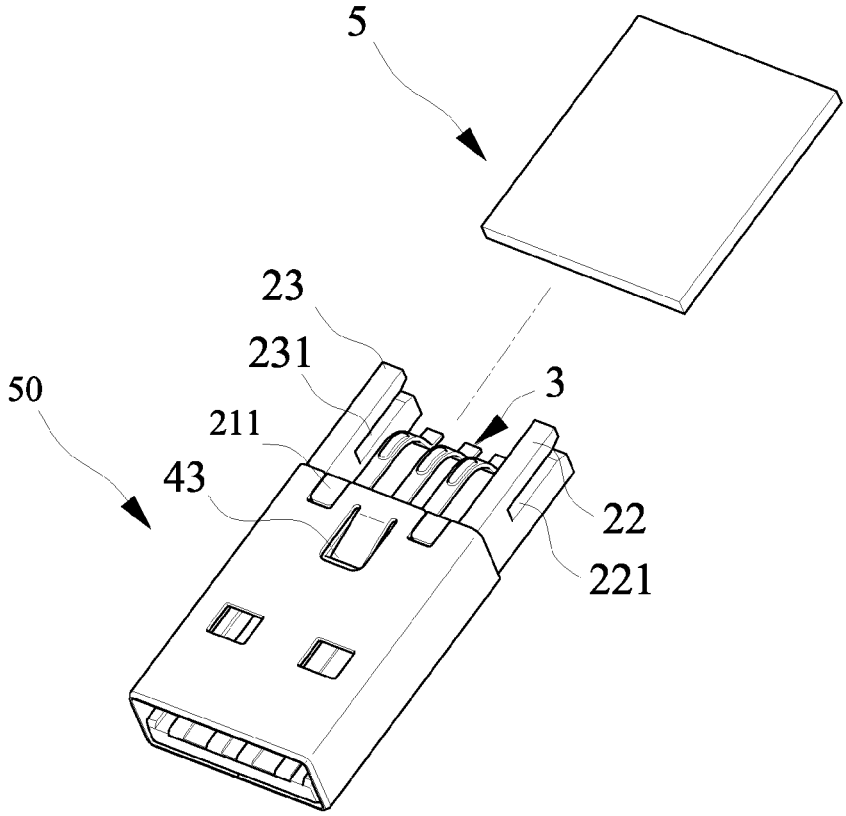
FIG. 4 illustrates the USB connector shown in FIG. 2 to be mounted on a circuit board.

Further referring to FIGS. 2, 3 and 4, when the integral housing body 1 is molded, firstly disposing a plurality of conductive terminals 3 within a predetermined mold, and then forming an integral housing body 1 by injection molding. The terminal bearing portion 21 of the insulative housing 2 extended outward two pairs of clasping tabs 211, 212 on the upper and lower surfaces respectively adjacent to the rear surface thereof, on the upper surface of the terminal bearing portion 21 and between the two clasping tabs 211 having a recess 213, wherein the clasping tabs 211, 212 and the recess 213 are mainly adapted to prevent the insert-molded member 1 from shifting back and forth within the metal shell 4 when the insert-molded member 1 and the metal shell 4 are assembled together. The terminal bearing portion 21 extends outward a first side arm 22 and a second side arm 23 being even with the two side surfaces thereof, each having a clipping groove 221, 231 for being inserted a circuit board 5, the area 24 defined by the first side arm 22 and second side arm 23 is provided for disposing the rear parts of conductive terminals 3. The rear part of each conductive terminal 3 has an arch portion 31 on which a projecting out, curved interfering portion 32 is defined for contacting with a contact of the circuit board to achieve signal connection in circuit.

The metal shell 4, stamped from a metal plate, is in shape of a rectangular figure communicated both front and back. The upper and lower surfaces of the metal shell 4 each have two grooves 41, 42 which can engage with the clasping tabs 211, 212, between the two grooves 41 having an abutting spring piece 43 for matching with the recess 213, thus the insert-molded member 1 is firmly secured within the metal shell 4 by double positioned location.

Figure 5:
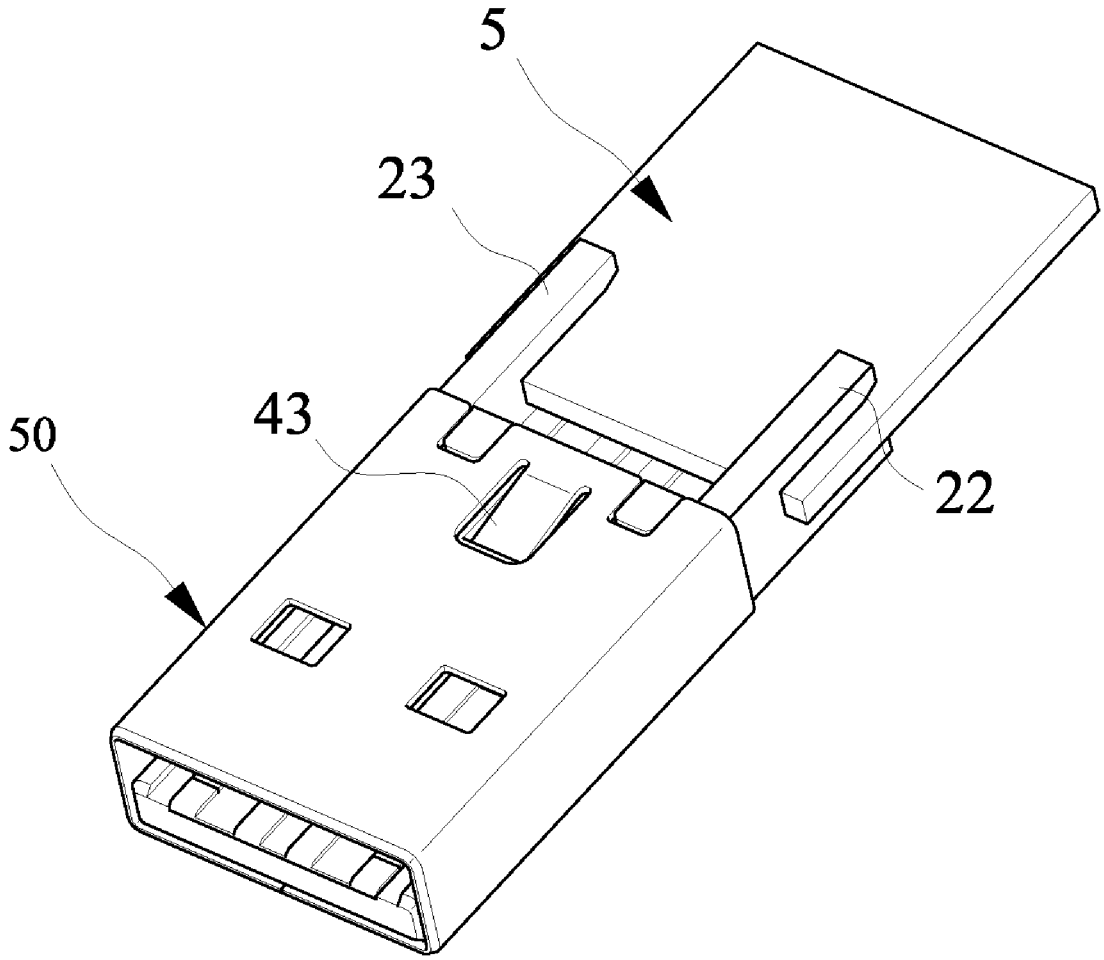
FIG. 5 illustrates the USB connector shown in FIG. 2 mounted on a circuit board.

In assembly, the electrical connector 50 of the present invention is only needed to assemble the predetermined insert-molded member 1 within the metal shell 4, as shown in FIG. 3. By mating the clasping tabs 211, 212 with the grooves 41, 42, it can prevent the insert-molded member 1 from sliding forward within the metal shell 4; by engaging the abutting spring pieces 43 with the recess 213, it can prevent the insert-molded member 1 from shifting backward within the metal shell 4, thus the insert-molded member 1 is secured firmly by two-way positioned location. Further referring to FIGS. 4 and 5, which show a circuit board 5 is being inserted into and has been inserted into the clipping grooves 221, 231 of the first and the second side arms 22, 23 from the rear side of the connector 50, the conductive terminals 3 are pressed against and positively contacted with the contacts of the circuit board 5 tightly for the arch portion 31 on the rear part thereof with elasticity, therefore the circuit board 5 can be connected with the connector 50 without needing to solder and thus achieve signal transmission through the interfering portion 32 and the circuit board 5.

While the invention herein disclosed has been described by means of specific embodiment, numerous modifications and variations could be made thereto by those skilled in the art without departing from the scope and spirit of the invention set forth in the claims.

What is claimed is:

1. A Universal Serial Bus (USB) connector adapted to mount on a circuit board, the USB connector comprising:

an insulative housing;

a plurality of conductive terminals each having a flexible arch portion and a projected out, curved interfering portion on the arch portion for electrically connecting to the circuit board engaged with the arch portion and interfering portion; and a metal shell;

wherein the insulative housing and the conductive terminals are insert-molded as an integral housing body having a front terminal bearing portion, a first side arm horizontally extending rearward from one side of the terminal bearing portion, and a second side arm horizontally extending rearward from the other side of the terminal bearing portion, each of the side arms has a horizontal orientation clipping groove together with the arch and interfering portions for being horizontally inserted the printed circuit board into the clipping groove so as to directly fasten the printed circuit board in the clipping groove, a front portion of the housing body is fastened in a rear portion of the metal shell, and the conductive terminals are disposed between the first and second side arms.

2. The USB connector of claim 1, wherein the terminal bearing portion of the insert-molded housing body is provided with a pair of clasping tabs on an upper and a lower surfaces thereof, and the metal shell is provided with trough corresponding to the clasping tabs.

3. A Universal Serial Bus (USB) connector adapted to mount on a circuit board, the USB connector comprising:

an insulative housing:

a plurality of conductive terminals each having an arch portion and an interfering portion for electrically connected with the circuit board; and a metal shell;

wherein the insulative housing and the conductive terminals are insert-molded as a housing body having a terminal bearing portion, a first side arm and a second side arm each extending rearward from one side surface of the terminal bearing portion, each of said side arm has a clipping groove for receiving the circuit board; and said conductive terminals are disposed between the first and second side arms;

wherein the housing body is provided with a pair of clasping tabs on an upper and a lower surfaces thereof, and the metal shell is provided with troughs corresponding to the clasping tabs;

wherein a recess is disposed between two clasping tabs on the upper surface of the housing body, and a spring piece abutting the recess is provided on the metal shell.

* * * * *